US005692443A

United States Patent [19]

Reutter

[11] Patent Number: 5,692,443

[45] Date of Patent: Dec. 2, 1997

[54] PLATE END CLAMPING DEVICE

[75] Inventor: Heinz-Walter Reutter, Frankenthal, Germany

[73] Assignee: Koenig & Bauer-Albert Aktiengesellschaft, Wurzburg, Germany

[21] Appl. No.: 616,318

[22] Filed: Mar. 15, 1996

[30] Foreign Application Priority Data

Mar. 16, 1995 [DE] Germany ..... 195 095 59.6

[51] Int. Cl.[6] ..... B41F 1/28

[52] U.S. Cl. ..... 101/415.1; 101/409

[58] Field of Search ..... 101/415.1, 409

[56] References Cited

U.S. PATENT DOCUMENTS 2,157,621 5/1939 Neilson ..... 101/415.1

FOREIGN PATENT DOCUMENTS 35 38 308 2/19

295 03 439 4/19

*Primary Examiner—*

*Assistant Examiner—*

*Attorney, Agent, or F*

[57]

The beveled ends of a flexible printing plate are clamped in a cylinder slot by a plurality of spring teeth that are receivable cutouts in the plate beveled ends. The spring teeth are part of a comb plate that is supported by a rotatable clamping lever. These teeth will also function as plate end ejectors when the clamping spindle is rotated in a plate end ejecting direction.

4 Claims, 2 Drawing Sheets

PLATE END CLAMPING DEVICE

FIELD OF THE INVENTION

The present invention is directed generally to a plate end clamping device. More particularly, the present invention is directed to a clamping device for clamping a flexible plate on a cylinder. Most specifically, the present invention is directed to a clamping device for clamping a flexible plate on a cylinder of a rotary printing press and for releasing the plate from the cylinder. The flexible plate or plates are formed with beveled or angled ends having end legs that are insertable into a narrow slit in the surface of the plate cylinder. A rotatable pivot lever or spindle is positioned within the cylinder and has a plurality of spring teeth which are engageable with the plate end legs. These spring teeth will act as plate end clamping elements upon rotation of the spindle in a first direction. Continued rotation of the spindle in this first direction will disengage the teeth from the plate end legs so that the teeth can function as plate end ejectors during rotation of the spindle in a second, opposite direction.

DESCRIPTION OF THE PRIOR ART

In the field of rotary printing, it is frequently necessary to attack flexible plates to the surfaces of cylinders. These flexible plates may be printing plates that are attached to printing cylinders, flexible resilient blankets that are attached to blanket cylinders or various spacers or covers that are attached no other press cylinders. Some type of plate end securing assembly is included on the cylinder and is used to engage the plate end or ends and to secure the plate to the cylinder. In order to most effectively utilize the cylinder or roller so which the plate, blanket, sheet or the like is attached, it is important to restrict as little cylinder surface area as possible for the plate end securement devices. This has given rise to cylinders that have narrow slits and to plates or blankets with beveled or angled ends with end legs which are received in those slits. The plate beveled ends or end legs are held in the slits by friction or by clamping or holding assemblies situated within the cylinder. In such devices, it is often difficult to provide simple, effective plate end holding or clamping devices, as well as plate end ejection devices while keeping the size of the cylinder slit or groove as small as possible while still insuring that the plate clamping device will function effectively.

In German Patent Publication DE 35 38 308 C2 there is shown a device which is usable to mount a rubber blanket on a blanket cylinder of a rotary printing press. In this prior art device, the rubber blanket cylinder is provided with an axially extending slit, into which the beveled or angled ends of a support plate for the rubber blanket are inserted. These angled or beveled ends of the blanket support plate have been provided with recesses and these plate end recesses are engaged by cams on a clamping lever. The clamping lever is pivotable or rotatable by use of a pivoting device that is secured to an end face of the blanket cylinder. This pivoting device is fixed in place on the end face of the rubber blanket cylinder.

A limitation of this prior art clamping device is that the clamping lever can be twisted along its length. This twisting of the clamping lever will result in the uneven application of a clamping force to the support plate. As a consequence, the support plate will not be clamped or held in a uniform manner across its width and may slip or become unsecured.

It will be seen that a need exists for a flexible plate clamping device that overcomes the limitations of the prior art. The plate end clamping device in accordance with the present invention provides such a device and is a significant improvement over the prior art devices.

SUMMARY OF THE INVENTION

It is an object of the present invention to provide a plate end clamping device.

Another object of the present invention is to provide a clamping device for clamping a flexible plate on a cylinder.

A further object of the present invention is to provide a clamping device for clamping a flexible plate on a cylinder of a rotary printing press.

Still another object of the present invention is to provide a plate end clamping device which is also operable as a plate end ejecting device.

Yet a further object of the present invention is to provide a plate end clamping and ejector device for clamping and ejecting flexible plates provided with beveled plate end legs on a cylinder provided with an axially extending slit.

As will be discussed in detail in the description of the preferred embodiment which is presented subsequently, the plate end clamping device in accordance with the present invention is intended for use in the clamping and ejection of plate ends with respect to a cylinder of a rotary printing press. The cylinder is provided with an axially extending, generally radially directed cylinder slit. The flexible plate has leading and trailing beveled plate ends with plate end legs that are insertable into the cylinder slit. A pivot lever or spindle is situated in the cylinder and is in contact with radially inner end of the cylinder slit. The pivot lever carries a plurality of resilient spring teeth with each tooth being sized and positioned to be engageable with a cooperatively shaped cutout or perforation on at least one of the beveled or angled end legs of the plate end being secured to the cylinder. In response to rotation of the pivot lever in a first direction these teeth will engage the cutouts in the plate end leg and will effect the clamping of the plate to the cylinder. Continued rotation of the pivot lever in this first direction will cause the spring teeth to move out of engagement with the plate end leg cutouts and to move past a leading edge of the plate end legs. Reversal of the direction of rotation of the pivot lever and rotation of the pivot lever in a second direction will cause the teeth to engage the plate beveled end leading edge and to act as plate end ejectors.

It is a particular advantage of the plate end clamping device in accordance with the present invention that various inaccuracies in, for example, the beveling of the plate ends, the perforations or cutouts of the plate end legs, the non-parallel seating of the clamping lever in relation to the beveled ends of the plate and the like can be compensated for. Any torsion occurring in the clamping lever can also be compensated for by the present plate end clamping device. The clamping of the flexible plate, which is uniform across the width of the plate, prevents excess stress on individual plate elements. This contributes to the overall operational dependability of the rotary printing press in which the subject device is used.

The plate end clamping device in accordance with the present invention also functions as a plate end ejector device. The clamping lever can be rotated to an extent sufficient to force the clamping teeth out of the plate end leg perforations and past the leading edges of the plate beveled ends. The direction of rotation of the clamping lever can then be reversed to eject the beveled plate ends from the cylinder slit.

The clamping device for flexible plates having beveled ends in accordance with the present invention overcomes the limitations of the prior art. It is a substantial advance in the art.

BRIEF DESCRIPTION OF THE DRAWINGS

While the novel features of the plate end clamping device in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
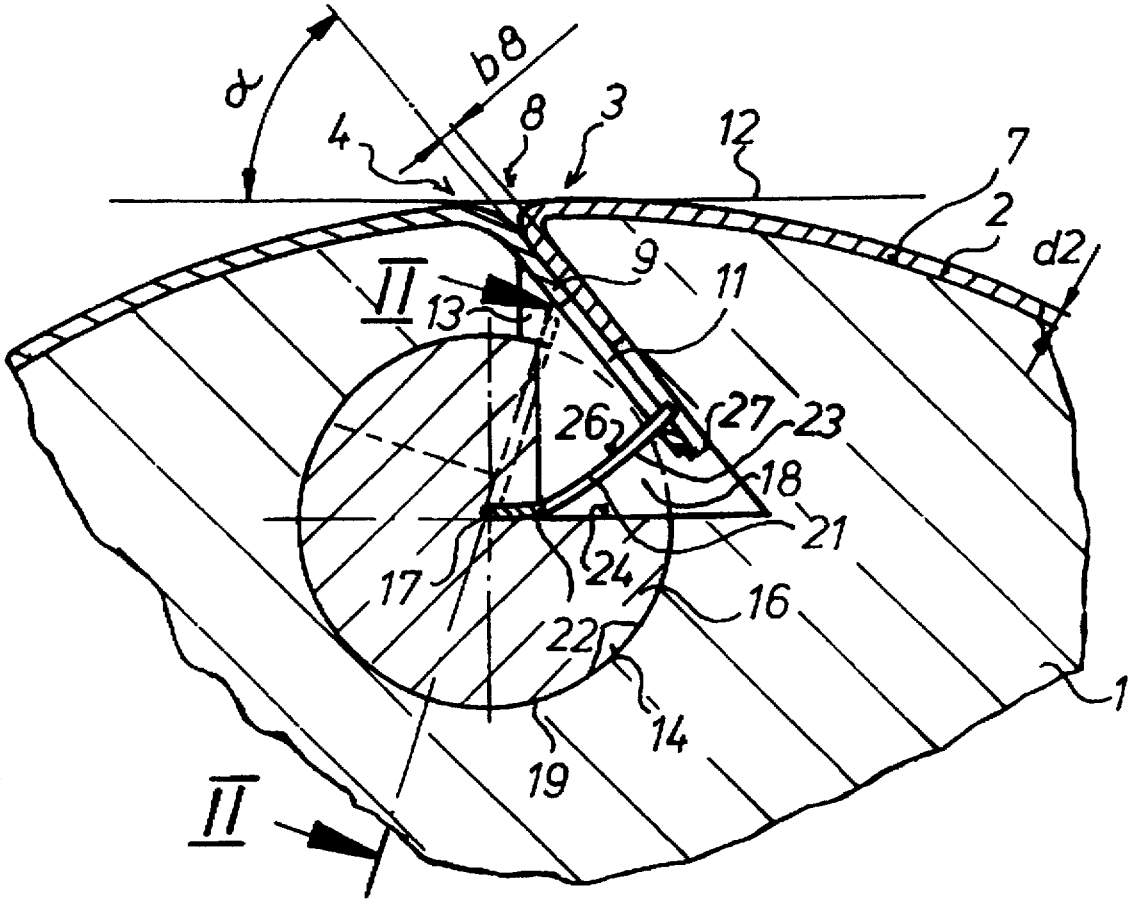
FIG. 1 is schematic sectional view of a portion of a cylinder in a rotary printing press and showing the plate end clamping device in accordance with the present invention in a plate end clamping position.
Figure 2:
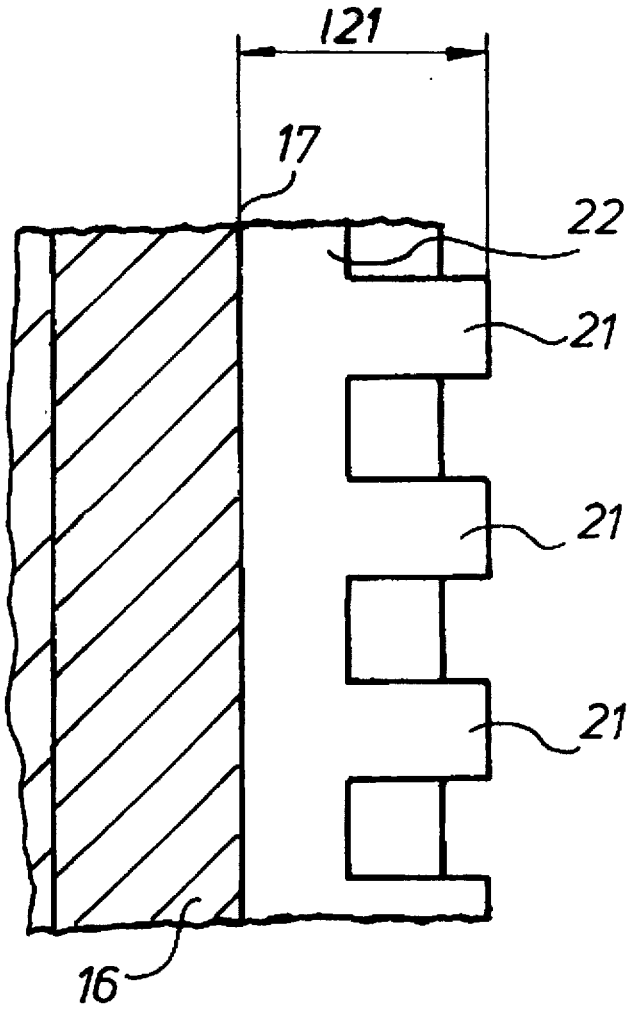
FIG. 2 is a sectional view of a portion of the clamping lever taken along line II-II of FIG. 1.

Referring initially to FIG. 1, and also referring to FIG. 2, there may be seen at 1 a portion of a cylinder which is a part of a rotary printing press and in which the plate end clamping device in accordance with the present invention is situated. It will be understood that cylinder 1 is a plate cylinder that forms part of a rotary printing press. Cylinder 1 could also be a resilient blanket cylinder or another type of cylinder which is utilized in a rotary printing press. The overall structure of the cylinder 1 and of the rotary printing press form no part of the subject invention and are thus not described in detail.

Cylinder 1 is structured to receive flexible printing plates 2 on its surface 7 and is provided with at least one axially extending, generally radially inwardly directed thin slit 8 that extends generally inwardly in cylinder 1 from a slit outer end at the surface 7 of the cylinder 1. The flexible printing plate 2, that is situated on the surface 7 of the cylinder 1, is provided with leading and trailing beveled or angled ends 3 and 4, respectively. As may be seen in FIG. 1, these leading and trailing beveled plate ends 3 and 4 are receivable in narrow slit 8 when flexible plate 2 is positioned on the surface 7 of the cylinder 1.

The flexible plate 2 has a plate thickness d2 of, for example, d2=0.3 mm. This plate, as discussed above, is preferably a printing plate. It may also be a support plate with a rubber blanket fastened to it, or may be another type of plate usable in a rotary printing press. The leading end 3 of the plate 2 has a leading end leg while the trailing end 4 has a trailing end leg 9. In the plate 2 depicted in the drawing, the trailing end leg 9 of the plate 2 is provided with a plurality of axially spaced, generally rectangular cutouts or perforations 11.

The thin cylinder slit 8 at its outer end has a slit width b8 which is at least twice the thickness d2 of the plate 2. Thus the slit radial outer end width b8=1 mm, for example. The slit 8 is inclined at an angle of inclination a of generally 450 with respect to a tangent line 12 which engages the surface 7 of the cylinder 1 in the area of the cylinder slit 8. As may be seen in FIG. 1, slit 8 widens or increases in cross-sectional width as it extends inwardly into the body of the cylinder 1. The slit 8 terminates, at its inner end, in a widened slit inner end chamber 13. As seen in FIG. 1, this chamber 13 is generally triangular in cross-sectional shape and has an apex adjacent the inner end of slit 8, and a wide base situated further within the interior of cylinder 1. An axially extending cylinder bore 14 extends generally parallel to the cylinder slit 8. The inner end of the slit 8 contacts the cylinder bore 14 in the form of a chord so that the cylinder bore 14 is connected with the slit.

A clamping lever 16, which may be a rotatable spindle 16, is rotatably seated in the cylinder bore 14. This spindle 16 has an axially extending groove or channel 18 that extends parallel with a pivot or rotational axis 17 of the spindle 16. This groove 18 is generally V-shaped in cross-section, as seen in FIG. 1 with the apex of the V situated generally adjacent the rotational axis 17 of the spindle 16, and with the open mouth of the groove 18 adjacent a peripheral surface 19 of the spindle 16. The apex of the V-shaped spindle groove 18 terminates in a narrow U-shaped slot which terminates at its inner end generally at the rotational axis 17 of the spindle 16.

A generally comb-shaped strip 22, which may be seen in greater detail in FIG. 2, is secured to the spindle 16 by insertion of a first end of the comb strip 22 into the U-shaped slot portion of the spindle groove 18. Thus the comb strip 22 is attached, in a cantilever manner, to the spindle 16. The free, outwardly extending end of the comb strip 22 is formed having a plurality of axially spaced teeth 21. These teeth 21 are individually resiliently seated in the circumferential direction of the spindle 16. In the plate end clamping device in accordance with the present invention, the comb strip 22 with its plurality of teeth 21 is embodied as a comb-shaped leaf spring which is pivotably or rotatably supported by the spindle 16 for rotational movement in the widened chamber 13 of the cylinder slit 8. In the present invention, the spacing of the teeth 21 and the perforations 11 on the trailing end leg 9 of the plate trailing end 4 of the plate 2 are dimensioned and adapted to be cooperative with each other. Thus the teeth 21 will fit into the cutouts 11 in the plate end leg 9 when the plate end 4 is inserted into the cylinder slit When it is desired to fasten a flexible plate 2 to the surface 7 of the cylinder, the leading and trailing plate end legs of the plate 2 will be inserted into the cylinder slit 8. Before insertion of the plate end legs into the cylinder slit 8 the clamping lever or spindle 16 will be positioned, as depicted in phantom line in FIG. 1, in a rest or ready position in which the comb teeth 21 are aligned generally radially with respect to the cylinder 1 with their free ends generally at the apex of the chamber 13 and do not project into the widest portion of the widened chamber 13 of the slit 8 which will receive the plate end legs. In this rest position the pivot lever or spindle 16 is turned so that the comb teeth 21 are pointing generally toward the outer end of the cylinder slit 8. Once the flexible plate leading and trailing ends have been inserted into the cylinder slit 8, the clamping lever or spindle 16 is rotated in a first, clockwise clamping direction by suitable means to move the spindle 16 into its working or clamping position which is depicted in solid lines in FIG. 1. In this clamping position, the teeth 21 of the resilient comb strip 22 will enter the generally rectangular cutouts or perforations in the end leg 9 of the trailing end 4 of the flexible plate 2. The teeth 21 have lower sides 23 which engage the surface of the perforations or cutouts 11 in the end leg 9 of the plate beveled end 4. The spring force of the comb teeth 21 thus exerts a tensioning force on the plate end 4 and pulls the plate end into the slit 8. The teeth 21 bend and in this way clamp the plate end 4 because of the generated spring force. Once the spindle 16 has been turned to its proper work position by suitable means, it will be arrested or held in that position by means of a lock bolt or another suitable holding device.

When the plate 2 is to be released from the surface 7 of the cylinder 1, the clamping spindle or lever 16 will be unlocked and will be rotated further in the first, clockwise direction. Since the comb teeth 21 are resilient, they will deflect further under this additional clockwise rotation of spindle 16 and will eventually be pulled downwardly out of engagement with the cutouts or perforations 11 in the plate trailing end leg 9 of the plate trailing end 4. Once the teeth 21 have passed a front face 27 of the end leg 9 of the plate beveled trailing end 4, they will again become straight and will extend radially outwardly from the spindle 16. In this position, the lower surfaces 23 of the teeth 22 will rest against a support surface 24 Of the spindle groove 18. In this undeflected or extended position, a length 121 of each of the teeth 21, in a radial direction is of such a dimension that the teeth extend past the front face 27 of the end leg 9 of the trailing end 4 of the plate 2. Now the clamping lever or spindle 16 can be turned back in a second, opposite, counterclockwise direction. This will bring an upper face 26 of each of the teeth 21 into contact with the front face 27 of the plate end leg 9. By continuing the rotation of the clamping lever or spindle 16 in this second, counterclockwise, plate end ejecting direction, the teeth 21 will exert an upwardly directed force on the plate trailing leg 9. This ejecting force will be sufficient to elevate the trailing plate end leg 9 out of the spindle slit 8 so that the plate end 4 can be grasped. It will thus be seen that the comb teeth 21 function both as clamping elements and also at plate end ejecting elements.

In accordance with the present invention, it would also be possible to substitute other elements for the above-described spindle 16 with the comb-like leaf spring fastened to it. Other pivotable clamping levers 16 such as, for example a strip with a plurality of individually spring teeth 21 could also be utilized. It would also be possible to dispose several clamping levers 16 on the cylinder so that each of several plates 2 that might be secured to the cylinder 1 would be provided with its own spindle 16.

While a preferred embodiment of a plate end clamping device in accordance with the present invention has been set forth fully and completely hereinabove, it will be apparent to one of skill in the art that a number of changes in, for example, the overall size of the cylinder, the type of printing being done by the printing press, the drive for the press and cylinder and the like could be made without departing from the true spirit and scope of the present invention which is accordingly to be limited only by the following claims.

What is claimed is:

1. A plate end clamping device for clamping a flexible plate having at least one beveled plate end with a plate end leg having a plurality of cutouts on a cylinder of a rotary printing press comprising:

an axially extending, generally radially inwardly directed cylinder slit in said cylinder, said slit extending inwardly in said cylinder from a slit outer end to a slit inner portion;

a clamping spindle having an axis of rotation and being rotatably situated in an axially extending bore in said cylinder, said clamping spindle contacting said slit;

an axially extending, radially outwardly opening groove in said clamping spindle, said groove having an apex generally at said clamping spindle axis of rotation and an open mouth adjacent a peripheral surface of said clamping spindle;

a plurality of spring teeth having first ends disposed in said groove in said clamping spindle and having resilient free ends extending out of said open mouth into said slit, each of said spring teeth free ends being receivable in one of said plurality of plate end leg cutouts, each of said spring teeth bending in said clamping spindle opening groove to exert a spring tensioning force on said plate end when said spindle is rotated in a first, clamping direction to a clamping position, each of said spring teeth further having an upper side; and a front face on said plate end leg, said clamping spindle being rotatable in said first direction past said clamping position to disengage said free ends of said spring teeth from said plate end leg cutouts and to move said upper side of each of said spring teeth into contact with said plate end let front face, said clamping spindle then being rotatable in a second, ejecting direction to engage said front face of said plate end let with said upper side of said spring teeth to elect said plate end leg from said slit.

2. The plate end clamping device of claim 1 further including a comb-like strip disposed in said groove in said clamping spindle, said comb-like strip being provided with said plurality of spring teeth.

3. The plate end clamping device of claim 2 wherein said comb-like strip is a leaf spring.

4. The plate end clamping device of claim 1 wherein each of said spring teeth has a lower side and further wherein said spindle groove has a support surface, said spring teeth lower sides being supportable by said support surface when said clamping spindle is rotated past said clamping position and before said clamping spindle is rotated in said ejecting direction.

* * * * *